US009855773B2

(12) United States Patent
Ishimori

(10) Patent No.: US 9,855,773 B2
(45) Date of Patent: Jan. 2, 2018

(54) PRINTER

(71) Applicant: Seiko Epson Corporation, Tokyo (JP)

(72) Inventor: Hiroyuki Ishimori, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/977,827

(22) Filed: Dec. 22, 2015

(65) Prior Publication Data

US 2016/0176209 A1 Jun. 23, 2016

(30) Foreign Application Priority Data

Dec. 22, 2014 (JP) ..... 2014-258395

(51) Int. Cl.
*B41J 15/04* (2006.01)
*B41J 29/02* (2006.01)

(52) U.S. Cl.
CPC ..... *B41J 15/04* (2013.01); *B41J 15/042* (2013.01); *B41J 29/02* (2013.01)

(58) Field of Classification Search
CPC ..... B41J 15/02; B41J 15/042; B41J 29/02
See application file for complete search history.

(56) References Cited

U.S. PATENT DOCUMENTS 6,474,883 B1 11/2002 Kawakami et al.
6,536,696 B2 3/2003 Fiutak et al.
2003/0002908 A1 1/2003 Hirabayashi et al.
2007/0002402 A1 1/2007 Ochiai et al.
2011/0072989 A1 3/2011 Ochiai et al.
2011/0074858 A1 3/2011 Ochiai et al.
2011/0268488 A1 11/2011 Inoue
2012/0038736 A1 2/2012 Ochiai et al.
2013/0259559 A1* 10/2013 Ishida ..... B41J 11/14 400/649

FOREIGN PATENT DOCUMENTS

| | | | |
|---|---|---|---|
| CN | 1393343 | A | 1/2003 |
| CN | 1891480 | A | 1/2007 |
| EP | 1 270 242 | A2 | 1/2003 |
| EP | 1 738 914 | A2 | 1/2007 |
| JP | 2000-289272 | A | 10/2000 |
| JP | 2001-287853 | A | 10/2001 |
| JP | 2005-088472 | A | 4/2005 |
| JP | 2007-076280 | A | 3/2007 |
| JP | 2007-210687 | A | 8/2007 |
| JP | 2010-167731 | A | 8/2010 |
| JP | 2011-143600 | A | 7/2011 |
| JP | 2011143600 | A * | 7/2011 |
| JP | 2011-230383 | A | 11/2011 |

* cited by examiner

*Primary Examiner* — Kristal Feggins
*Assistant Examiner* — Kendrick Liu
(74) *Attorney, Agent, or Firm* — Nutter McClennen & Fish LLP; John J. Penny, Jr.

(57) ABSTRACT

A printer performing a printing operation on a roll sheet includes a roll sheet holder in which the roll sheet is stored, a roll sheet input port through which the roll sheet is input to the roll sheet holder, an opening/closing cover unit that opens and closes the roll sheet input port, and a link member that links the opening/closing cover unit with the roller sheet holder. The opening/closing cover unit is movable among an open position, a closed position, and a support position between the open position and the closed position.

6 Claims, 4 Drawing Sheets

PRINTER

The disclosure of Japanese Patent Application No. 2014-258395 filed on Dec. 22, 2014, including specifications, drawings and claims are incorporated herein by reference in its entirety.

BACKGROUND

1. Technical Field

The present invention relates to a printer that opens an opening/closing cover of a roll sheet input port and replaces a roll sheet supported in a roll sheet holder.

2. Related Art

In a roll sheet printer (printer) that a roll sheet in which a long recording sheet is rolled is loaded into a roll sheet holder, the recording sheet is drawn out of the roll sheet, and a printing operation is performed thereon, the roll sheet input port is formed in a printer case in which a printing mechanism, the roll sheet holder, and the like are accommodated. When a roll sheet is replaced, an opening/closing cover of the roll sheet input port is opened, the roll sheet is taken out of the roll sheet holder, and a new roll sheet is input. Since the opening/closing cover is mounted on an opening/closing cover unit on which a platen roller or the like is mounted, the roll sheet holder is opened by opening the opening/closing cover and the roll sheet can be replaced. Japanese Unexamined Patent Application Publication No. 2000-289272 discloses such a type of roll sheet printer.

SUMMARY

In the configuration in which a roll sheet input port is opened on a device front surface and a roll sheet is rolled front from a roll sheet holder when an opening/closing cover is opened, a user does not need to input a hand into the roll sheet hold and take out a roll sheet in replacing the roll sheet. However, when a roll sheet input port is opened on a device top surface, a large space through which a hand is input into the roll sheet holder is required to take out a roll sheet on the bottom of the roll sheet holder in replacing the roll sheet. Accordingly, it is necessary to increase the size of the roll sheet holder, which is disadvantageous for a decrease in size of a printer.

The present invention is made in consideration of the above-mentioned circumstances and an object thereof is to provide a printer in which a roll sheet can be input and output with a small space and maintenance in workability in replacing a roll sheet and a decrease in size of a device can coexist.

In order to achieve the above-mentioned object, according to an aspect of the present invention, there is provided a printer performing a printing operation on a roll sheet, including: a roll sheet holder in which the roll sheet is stored; a roll sheet input port through which the roll sheet is input to the roll sheet holder; an opening/closing cover unit that opens and closes the roll sheet input port; and a link member that links the opening/closing cover unit with the roller sheet holder with each other, wherein the opening/closing cover unit is movable among an open position, a closed position, and a support position between the open position and the closed position.

In the printer according to the present invention, in this way, the roll sheet holder moves from the storage position deeper inside the roll sheet input port to the takeout position at which the roll sheet can be taken out by linking the roll sheet holder with the opening/closing cover that opens and closes the roll sheet input port. Accordingly, it is not necessary to install a large space through which a hand is input into the roll sheet holder in order to take out the roll sheet and it is possible to input and output the roll sheet with a small space. Accordingly, it is possible to maintain workability in replacing a roll sheet and to decrease a size of the device.

In the printer according to the present invention, the link member may move the roll sheet holder to a takeout position at which the roll sheet is able to be taken out through the roll sheet input port when the opening/closing cover unit is moved to the open position, and may move the roll sheet holder to a storage position which is deeper in the roll sheet input port than the takeout position when the opening/closing cover unit is moved to the closed position. By employing this configuration, the roll sheet holder can be moved to the takeout position when the opening/closing cover is opened. Accordingly, it is possible to enhance workability in replacing a roll sheet.

The printer according to the present invention may further include: a frame in which a guide groove is formed; and a movable shaft that moves along the guide groove, the movable shaft may be disposed in a connecting portion of the roll sheet holder and the link member, the roll sheet holder may be located at the takeout position when the movable shaft is located at a first position in the guide groove, and the roll sheet holder may be located at the storage position when the movable shaft is located at a second position in the guide groove. In this case, since a mechanism moving the movable shaft which is guided in the grooved formed in the frame and which is connected to both the roll sheet holder and the link member is used, the opening/closing cover can be linked with the roll sheet holder using a simple and space-saving mechanism. Accordingly, the present invention is advantageous for a decrease in size.

In the printer according to the present invention, the link member may support the opening/closing cover unit at the open position when the movable shaft is located at the first position in the guide groove, and may support the opening/closing cover unit at the closed position when the movable shaft is located at the second position in the guide groove. By employing this configuration, when the roll sheet holder is moved to the takeout position, the opening/closing cover can be supported at the open position. Accordingly, it is possible to enhance workability in replacing a roll sheet.

In the printer according to the present invention, the guide groove may include a protrusion, and the protrusion may support the movable shaft at a third position which is a position between the first position and the second position. By employing this configuration, the roll sheet holder can be supported at the takeout position in a state in which the opening/closing cover is opened. Particularly, when the roll sheet input port is set to face the upside and a load of the roll sheet is applied to the roll sheet holder, the roll sheet holder can be supported at the takeout position or in the vicinity thereof. Accordingly, it is possible to enhance workability in replacing a roll sheet.

In the printer according to the present invention, the link member may support the opening/closing cover unit at the support position between the open position and the closed position when the movable shaft is located at the third position in the guide groove. By employing this configuration, it is possible to maintain a state in which the opening/closing cover unit is supported at the support position between the open position and the closed position. Accordingly, it is possible to enhance workability in replacing a roll sheet.

In the printer according to the present invention, the movable shaft may pass over the protrusion formed in the guide groove when the opening/closing cover unit starts movement from the support position to the closed position. By employing this configuration, when the roll sheet is completely replaced, the state in which the roll sheet holder is supported at the takeout position can be released by only performing an operation of closing the opening/closing cover unit.

In the printer according to the present invention, the printer may be able to be set in a first set posture in which the roll sheet input port faces a top side and a second set posture in which the roll sheet input port faces a front side, the opening/closing cover unit may be opened and closed in an up-down direction about a rear end thereof in the first set posture and may be opened and closed in a front-rear direction about a bottom end thereof in the second set posture. By employing this configuration, the roll sheet can be taken out to the top side in the first set posture and the roll sheet can be taken out to the front side in the second set posture. Accordingly, it is possible to set the printer in a posture suitable for the circumstances of a setting place, which is very convenient. Even when the roll sheet input port is opened to any of the top side and the front side, it is not necessary to provide a large space for inputting a hand into the roll sheet holder so as to take out the roll sheet. Accordingly, it is possible to input and output a roll sheet with a small space. As a result, it is possible to maintain workability in replacing a roll sheet and decrease a device size.

DESCRIPTION OF EXEMPLARY EMBODIMENTS

Hereinafter, a roll sheet printer according to an embodiment of the present invention will be described with reference to the accompanying drawings.

Entire Configuration

Figure 1A:
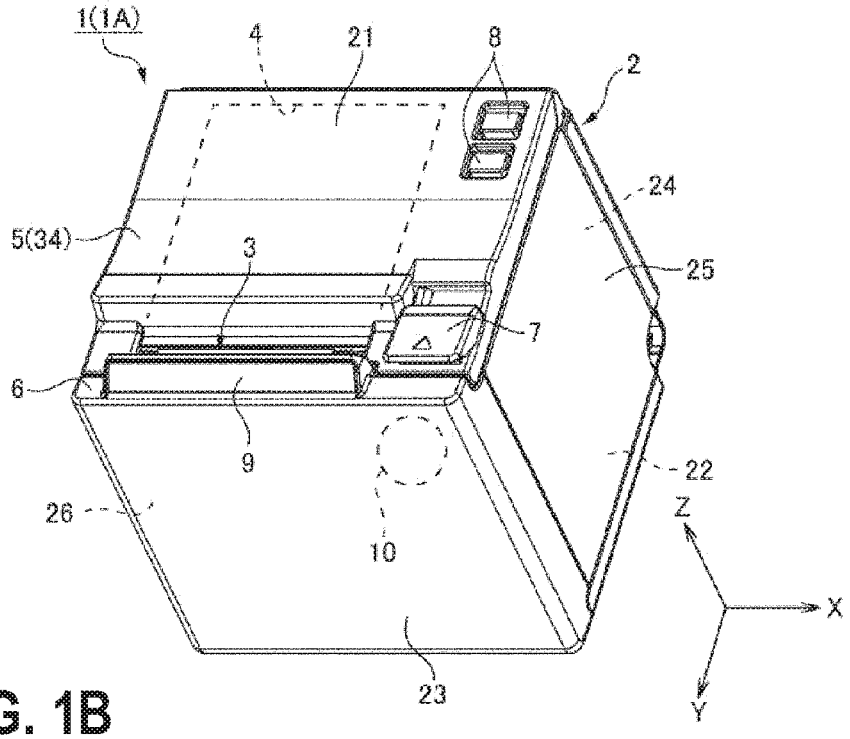
FIGS. 1A and 1B are perspective views illustrating an appearance of a roll sheet printer according to an embodiment of the present invention.
Figure 1B:
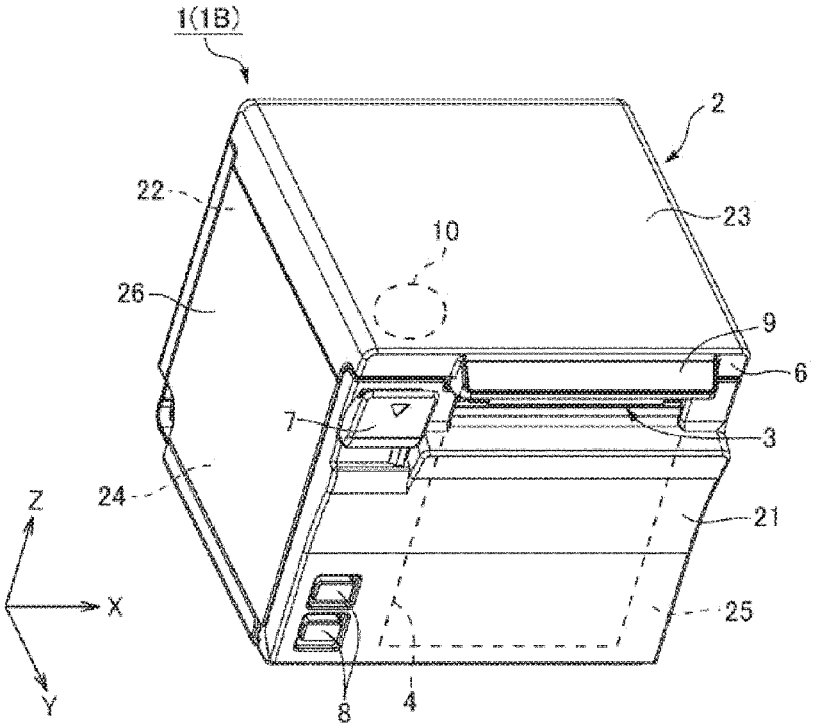

FIGS. 1A and 1B are perspective views illustrating an appearance of a roll sheet printer according to an embodiment of the present invention. Hereinafter, in this specification, three directions perpendicular to each other are defined as an X direction, a Y direction, and a Z direction. In three directions of the X, Y, and Z directions illustrated in FIGS. 1A and 1B, the direction of an arrow indicates a + direction (positive direction) and the reverse direction of the direction of the arrow indicates a − direction (negative direction). In a usage state, the roll sheet printer 1 (printer) is disposed on an XY plane which is a horizontal plane. The roll sheet printer 1 loads a roll sheet 12 (see FIG. 2) in which a long recording sheet 11 (see FIG. 2) is wound in a roll shape therein and performs a printing operation on the recording sheet 11 unwound from the roll sheet 12.

The roll sheet printer 1 includes a printer case 2 having a rectangular parallelepiped shape as a whole. The printer case 2 includes a first face 21 on which a recording sheet ejection port 3 is formed. In the set posture illustrated in FIG. 1A, the first face 21 faces the upper side (the +Z side) and the recording sheet ejection port 3 is located at an edge on the front side (the +Y side) of the first face 21. In this way, the set posture in which the recording sheet ejection port 3 is located at the front edge (the near side from a user) of the top face of the printer case 2 is a first set posture 1A of the roll sheet printer 1. The printer case 2 includes a second face 22 constituting a bottom face (a face on the −Z side) in the first set posture 1A, a third face 23 constituting a front face (a face on the +Y side) in the first set posture 1A, a fourth face 24 constituting a rear face (a face on the −Y direction) in the first set posture 1A, a fifth face 25 constituting one face (a face on the +X side) in the width direction in the first set posture 1A, and a sixth face 26 constituting one face (a face on the −X side) in the width direction in the first set posture 1A.

On the other hand, in the set posture illustrated in FIG. 1B, the first face 21 of the roll sheet printer 1 faces the front side (the +Y side) and the recording sheet ejection port 3 is disposed on the front face of the roll sheet printer 1. This posture is a second set posture 1B of the roll sheet printer 1. In the second set posture 1B, the second face 22 constitutes the rear face (the face on the −Y side), the third face 23 constitutes the front face (the face on the +Z side), and the fourth face 24 constitutes the bottom face (the face on the −Z side). The fifth face 25 and the sixth face 26 constitute one face (the face on the +X side) in the width direction and the other face (the face on the −X side) in the width direction similarly to the first set posture 1A.

Hereinafter, the configuration of the first face 21 and the third face 23 of the roll sheet printer 1 will be described based on the assumption that the roll sheet printer 1 is set in the first set posture illustrated in FIG. 1A.

A rectangular roll sheet input port 4 through which a roll sheet 12 is input and output is formed on the first face 21 of the printer case 2. The first face 21 includes an opening/closing cover 5 covering the roll sheet input port 4 and a front end portion 6 extending along an edge on the +Y side of the roll sheet input port 4. The opening/closing cover 5 is movable between a closed position 5A illustrated in FIG. 1A and an open position 5B (see FIG. 3) which is rotated upward (to the +Z side) about the rear end (an end on the −Y side) thereof. In a state in which the opening/closing cover 5 is located at the closed position 5A, the recording sheet ejection port 3 having a slit shape extending in the X direction is formed between the opening/closing cover 5 and the front end portion 6. The opening/closing cover 5 includes an opening/closing lever 7 which is located on one side (on the +X side) in the width direction of the recording sheet ejection port 3. When the opening/closing lever 7 is pulled upward with a finger, a lock not illustrated is released. Accordingly, the opening/closing cover 5 can be opened upward.

An operation unit 8 such as a power supply switch is disposed at a corner on the rear side (the −Y side) of the opening/closing cover 5. The front end portion 6 of the first face 21 includes an inclined face (an inclined face facing the +Y side and the +Z side) which is inclined obliquely-upward to the front side and a display unit 9 is disposed on the inclined surface. The display unit 9 displays a variety of information such as an operation state of the roll sheet printer 1. The display unit 9 extends along the top end portion of the third face 23 connected to the first face 21. In the top end portion of the third face 23, an NFC communication unit 10 that reads information from an NFC chip mounted on a mobile terminal or the like of a user in a noncontact manner is disposed on one side (on the +X side) in the width direction thereof. The roll sheet printer 1 can perform a printing operation based on the information read by the NFC communication unit 10.

When the roll sheet printer 1 is set in the first set posture 1A illustrated in FIG. 1A, the recording sheet ejection port 3, the display unit 9, and the NFC communication unit 10 are concentrated at the corners at which the device top face and the device front face are connected. That is, the recording sheet ejection port 3, the display unit 9, and the NFC communication unit 10 are concentrated and disposed at a position which can be easily accessed on the near side from the user. When the roll sheet printer is set in the second set posture 1B illustrated in FIG. 1B, the recording sheet ejection port 3, the display unit 9, and the NFC communication unit 10 are concentrated at the corners at which the device top face and the device front face are connected. The first set posture 1A illustrated in FIG. 1A is a posture in which the first face 21 including the recording sheet ejection port 3 is the device top face and a recording sheet 11 subjected to the printing operation can be ejected upward (to the +Z side) from the device top face. On the other hand, the second set posture 1B illustrated in FIG. 1B is a posture in which the first face 21 including the recording sheet ejection port 3 is the device front face and a recording sheet 11 subjected to the printing operation can be ejected forward (to the +Y side) from the device front face. In this way, the roll sheet printer 1 can be set to have two takeout directions of a recording sheet 11 such as the top side and the front side depending on the circumstances of the set place. In any posture, convenience of operations is not damaged.

In the first set posture 1A illustrated in FIG. 1A, the opening/closing cover 5 is opened upward (to the +Z side) about the rear end as described above and the roll sheet input port 4 is opened upward. Accordingly, the operation of replacing the roll sheet 12 can be performed by taking out the roll sheet 12 from the top side and inputting the roll sheet 12 from the top side. On the other hand, in the second set posture 1B illustrated in FIG. 1B, the opening/closing cover 5 is opened forward (to the +Y side) about the bottom end thereof. The roll sheet input port 4 is opened forward. Accordingly, the operation of replacing the roll sheet 12 can be performed by taking out the roll sheet 12 from the front side and inputting the roll sheet 12 from the front side. As a result, in any posture, the operation of replacing the roll sheet 12 can be easily performed.

Internal Structure

Figure 2:
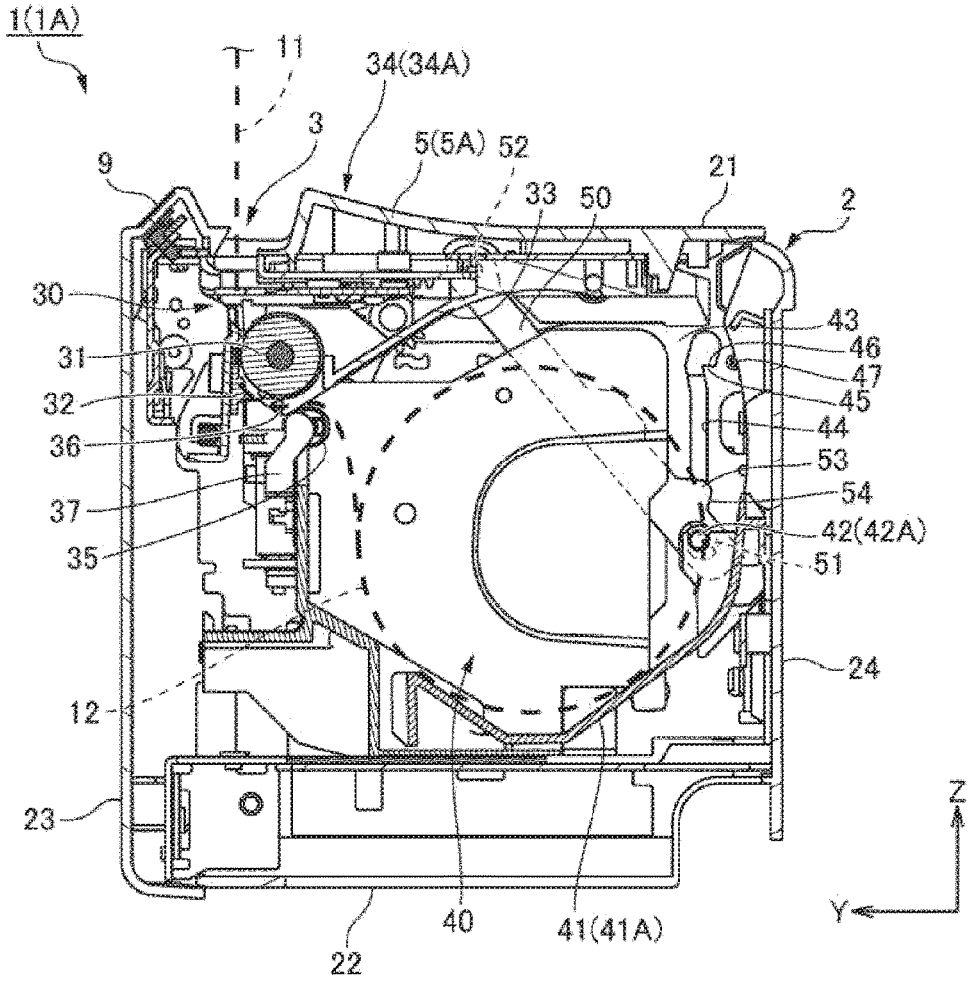
FIG. 2 is a longitudinal-sectional view (a closed position) illustrating an internal structure of the roll sheet printer.
Figure 3:
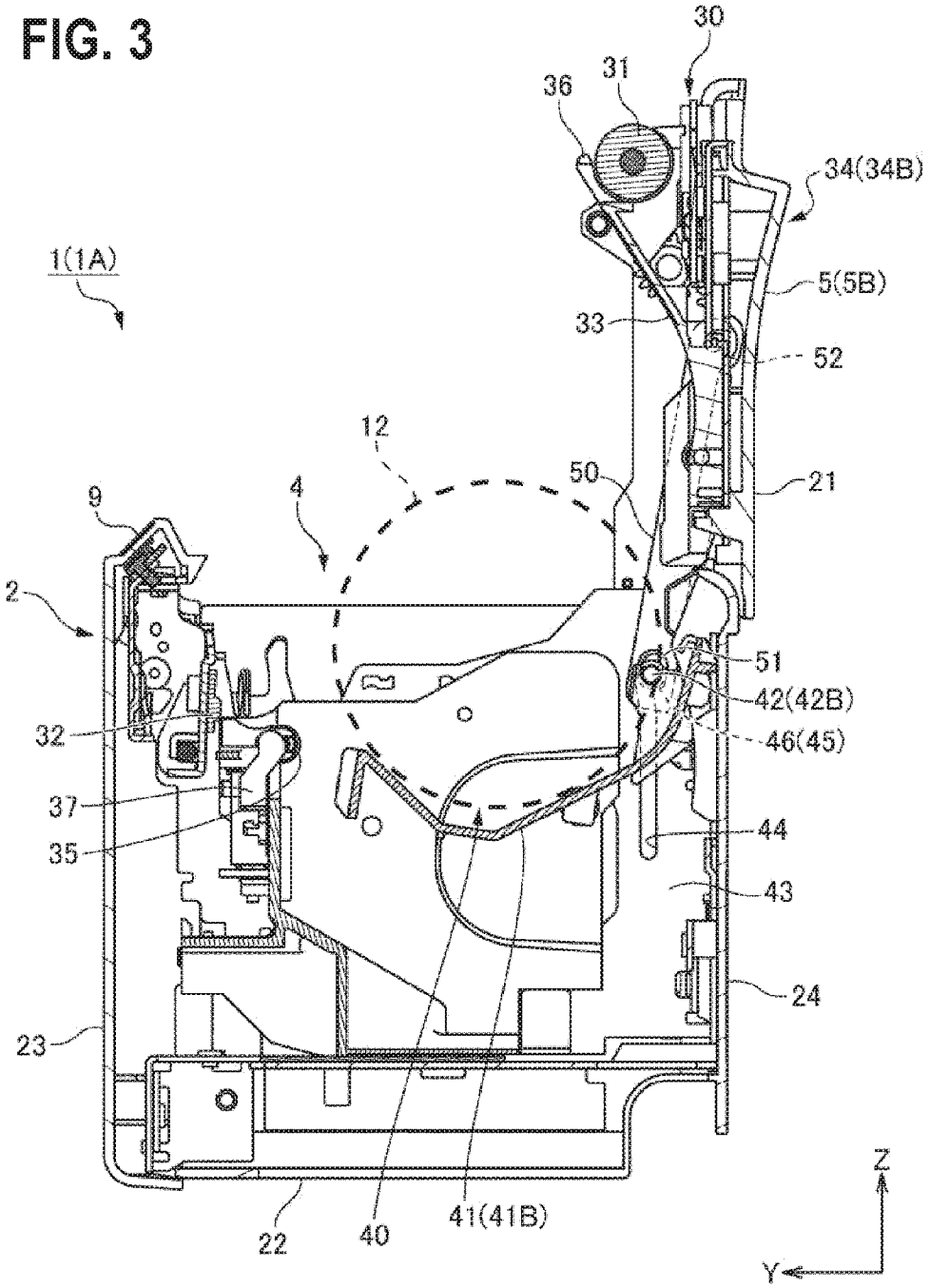
FIG. 3 is a longitudinal-sectional view (an open position) illustrating an internal structure of the roll sheet printer.

FIGS. 2 and 3 are longitudinal-sectional views illustrating an internal structure of the roll sheet printer 1, where FIG. 2 illustrates a state in which the opening/closing cover 5 is closed and FIG. 3 illustrates a state in which the opening/closing cover 5 is opened. FIGS. 2 and 3 illustrate a state in which the roll sheet printer 1 is set to the first set posture 1A illustrated in FIG. 1A. A recording sheet cutting mechanism 30 cutting the recording sheet 11 in the vicinity of the recording sheet ejection port 3 is disposed in the printer case 2. A platen roller 31 and a print head 32 are disposed below the recording sheet cutting mechanism 30. The platen roller 31 is mounted on a platen support frame 33 supporting the opening/closing cover 5 from the rear side (the −Z side). The mechanisms such as the opening/closing cover 5, the recording sheet cutting mechanism 30, and the platen roller 31 constitutes an opening/closing cover unit 34 which is opened and closed along with the platen support frame 33. When the opening/closing cover unit 34 is located at a closed position 34A, the opening/closing cover 5 is located at the closed position 5A. When the opening/closing cover unit 34 is located at an open position 34B, the opening/closing cover 5 is located at the open position 5B.

A roll sheet storage section 40 is disposed below the opening/closing cover unit 34. The roll sheet storage section 40 includes a roll sheet holder 41 that contains a roll sheet 12. The central portion in the Y direction of the roll sheet holder 41 is recessed to the −Z side and this recessed portion faces the roll sheet input port 4 of the first face 21. As illustrated in FIG. 3, when the opening/closing cover unit 34 is opened, the roll sheet 12 can be input to and output from the roll sheet holder 41 through the roll sheet input port 4. The input roll sheet 12 is supported on the bottom of the roll sheet holder 41 in a rolling state.

The front end (an end on the +Y side) of the roll sheet holder 41 rises upward (to the +Z side) and an input roller 35 as a follower roller is disposed on the top end thereof. The recording sheet 11 unwound from the roll sheet 12 is suspended on the input roller 35 and is then stretched over a sheet guide 36 disposed at the lower end of the platen support frame 33. The recording sheet 11 is set to pass through the platen roller 31 and the print head 32 from the sheet guide 36 and is drawn to the upper side of the printer case 2 from the recording sheet ejection port 3 via the recording sheet cutting mechanism 30. Since the sheet guide 36 protrudes obliquely downward, a conveyance path passing through the input roller 35 and the sheet guide 36 is curved to protrude upward. A sheet detection lever 37 is disposed at the position in the curved path. The sheet detection lever 37 comes in contact with the recording sheet 11 conveyed in a curved state to protrude upward from the lower side (the inside of the curved shape) and detects the recording sheet 11.

Mechanism Linking Opening/Closing Cover Unit with Roller Sheet Holder

The rear end (an end on the −Y side) of the roll sheet holder 41 rises upward (to the +Z side) and guide pins 42 (movable shaft) are formed at both ends in the width direction (in the X direction). The guide pin 42 is a shaft-shaped member protruding outward to the outside in the width direction of the roll sheet holder 41. Fixed frames 43 are disposed on the rear sides (inside) of the fifth face and the sixth face and on both sides in the width direction of the roll sheet holder 41. Guide grooves 44 extending the up-down direction (in the Z direction) are formed in rear portions (on the −Y side) of the pair of fixed frames 43. The roll sheet holder 41 is mounted such that the guide pins 42 protruding to both sides in the width direction are inserted into the guide grooves 44 of the fixed frames 43. When the guide pins 42 is guided by the guide grooves 44 so as to move in the up-down direction, the roll sheet holder 41 moves in the up-down direction as a whole.

A link member 50 is disposed in a space between the roll sheet holder 41 and the fixed frames 43 disposed on the outsides in the width direction (in the X direction) of the roll sheet holder 41. Long holes 51 are formed at one end (a lower end) of the link member 50. The guide pins 42 of the roll sheet holder 41 are inserted into the long holes 51. The link member 50 is connected to the roll sheet holder 41 by causing the long holes 51 to engage with the guide pins 42. The other end (an upper end) of the link member 50 is connected substantially to the center in the front-rear direction (in the Y direction) of the platen support frame 33. The connecting portion of the link member 50 and the platen support frame 33 is a pin contact point 52. A pair of link members 50 disposed on both sides in the width direction of the roll sheet holder 41 constitutes a link mechanism supporting the opening/closing cover unit 34 via the pin contact point 52 which is the connecting portion to the platen support frame 33. Since the link members 50 are connected to the roll sheet holder 41 via the guide pins 42 engaging with the long holes 51, the roll sheet holder 41 can be linked with the opening/closing cover unit 34 via the link member 50.

As illustrated in FIG. 2, when the opening/closing cover 5 is located at the closed position 5A and the opening/closing cover unit 34 is located at the closed position 34A, the link member 50 has an inclined posture which extends from the pint contact point 52 located substantially at the center of the substantially-horizontal platen support frame 33 obliquely rearward to the lower side, and supports the opening/closing cover unit 34 in this posture. In this state, the guide pins 42 engaging with the long holes 51 of the link members 50 are located at lower end positions 42A (the second position) on the lower sides of the guide grooves 44. The roll sheet holder 41 having the guide pins 42 formed therein is located at the storage position 41A which is closer to the bottom of the printer case 2 than the roll sheet holder 41.

When the opening/closing cover 5 is opened upward (to the +Z side) from the state illustrated in FIG. 2, the opening/closing cover 5 and the platen support frame 33 rotate upward together. Accordingly, the link members 50 rise upward along with the platen support frame 33 and rotate upward, but the lower ends of the link members 50 are guided along the guide grooves 44 to rise via the guide pins 42 engaging with the guide grooves 44. When the opening/closing cover 5 reaches the open position 5B and the opening/closing cover unit 34 reaches the open position 34B, a vertical posture in which the platen support frame 33 and the opening/closing cover 5 extend in the Z direction is obtained. The link members 50 have a posture in which the upper ends are slightly inclined obliquely rearward. In this state, the guide pins 42 rise to the upper end positions 42B (the first position) close to the top ends of the guide grooves 44. The roll sheet holder 41 rises to the takeout position 41B closer to the roller sheet input port 4 than the storage position 41A.

Figure 4:
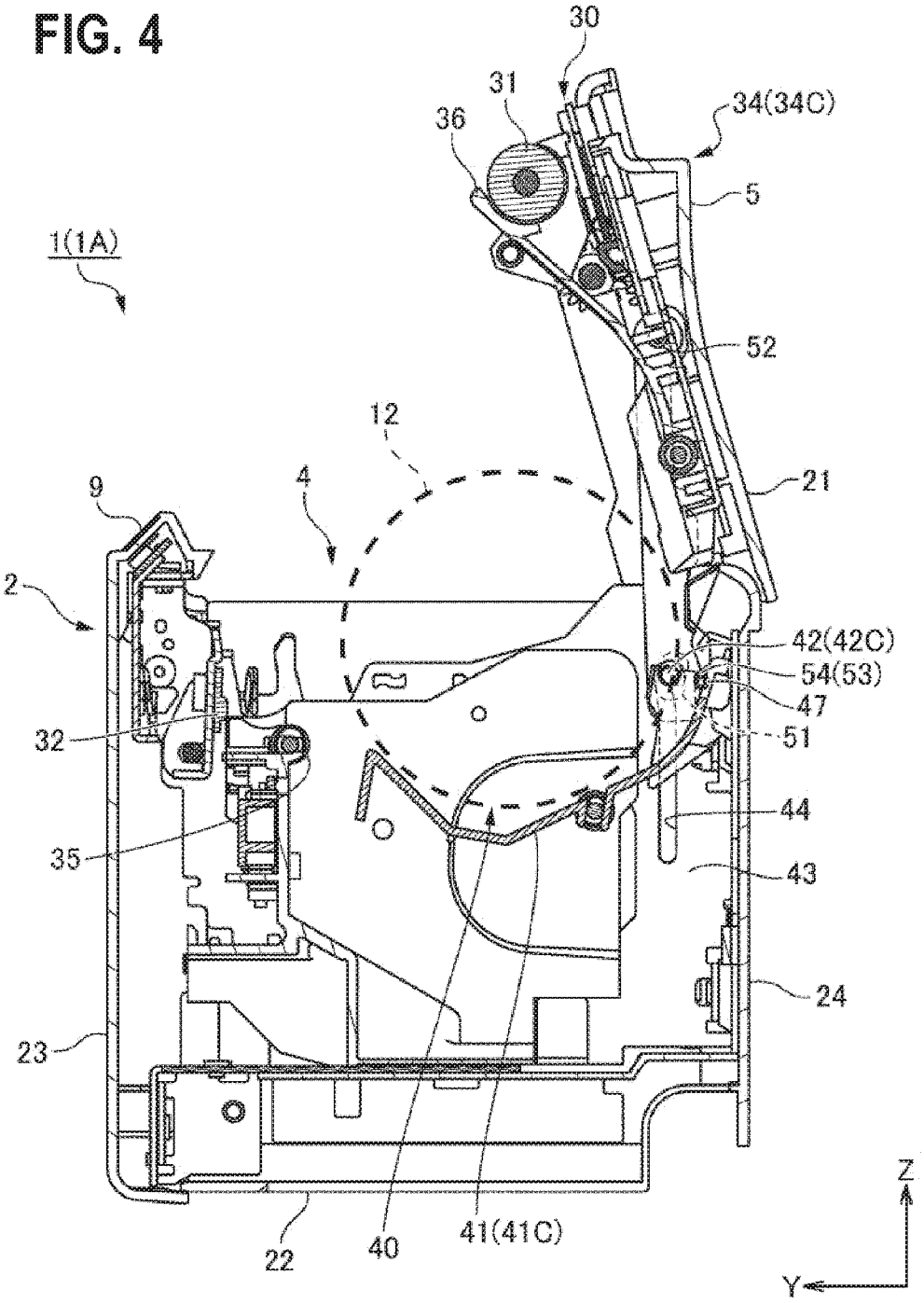
FIG. 4 is a longitudinal-sectional view (an intermediate position of a closing operation) illustrating an internal structure of the roll sheet printer.

FIG. 4 is a longitudinal-sectional view illustrating an internal structure of the roll sheet printer 1 and illustrates a state in which the opening/closing cover unit 34 is located at an intermediate position of the closing operation. The guide grooves 44 include an engagement protrusion 45 (an engaging portion) engaging with and supporting the guide pins 42 at an intermediate position 42C (the third position) between the lower end position 42A and the upper end position 42B. The intermediate position 42C is a position in the vicinity of the upper end position 42B. The engagement protrusion 45 protrudes to the +Y side from an edge on the rear side (on the −Y side) of the guide groove 44. The edge on the upper side (on the +Z side) of the engagement protrusion 45 includes a support face 46 extending to be substantially horizontal. The portion of the guide groove 44 above the engagement protrusion 45 is bent obliquely rearward. Accordingly, in moving to the upper end along the guide groove 44, the guide pin 42 passes over the engagement protrusion 45 and moves up to the upper end position 42B. When the guide pin slightly moves backward from the upper end position 42B toward the lower end position 42A, the guide point is guided to the position (the intermediate position 42C) going over the support face 46. When the guide pin 42 goes over the support face 46, the guide pine 42 is supported from the downside. Accordingly, the backward movement of the link member 50 is regulated via the guide pin 42. As a result, in this state, the link members 50 support the opening/closing cover unit 34 at the support position 34C between the open position 34B and the closed position 34A.

The support position 34C of the opening/closing cover unit 34 is a position to which the opening/closing cover unit 34 rotates from the open position 34B substantially to the closed position side (to the +Y side) as illustrated in FIG. 4 and at which the link member 50 and the opening/closing cover unit 34 are inclined substantially obliquely forward. The roll sheet holder 41 connected to the link member 50 is supported at the holder support position 41C between the takeout position 41B and the storage position 41A. The holder support position 41C is a position slightly lower than the takeout position 41B. In this state, even when the weight of the roll sheet 12 is applied to the roll sheet holder 41, the roll sheet holder 41 does not go down and the roll sheet holder 41 is supported at the holder support position 41C.

Operation of Disengaging Guide Pin

As described above, in the state in which the opening/closing cover 5 is located at the open position 5B and the opening/closing cover unit 34 is located at the open position 34B, the guide pins 42 are in the engaging state in which the guide pins go over the support faces 46. In this state, the guide pins 42 and the engagement protrusions 45 are disengaged by the operation of closing the opening/closing cover unit 34, and the guide pins 42 are moved to below the engagement protrusions 45.

As illustrated in FIG. 2, a protruding portion 53 protruding to the rear side (the −Y side) in the vicinity of the long hole 51 is formed in the link member 50. The protruding portion 53 includes an inclined face 54 of which the protruding length to the rear side (the −Y side) increases toward the pin contact point 52. In the fixed frame 43, a protrusion 47 is formed at a position slightly higher (on the +Z side) than the engagement protrusion 45 on the rear side (the −Y side) of the guide groove 44. The protrusion 47 protrudes from the fixed frame 43 to a side on which the roll sheet holder 41 and the link member 50 are disposed.

The lower end portion of the link member 50 passes along a locus moving forward (to the +Y side) when the guide pin 42 passes over the engagement protrusion 45 in opening the opening/closing cover unit 34 and then moving rearward (to the −Y side) along the curved shape of the upper end of the guide groove 44. Accordingly, the protruding portion 53 formed in the vicinity of the lower end of the link member 50 once moves forward (to the +Y side) when passing through the vicinity of the protrusion 47 formed in the fixed frame 43. As a result, the protruding portion 53 can move over the protrusion 47 without interfering with the protrusion 47. When the opening/closing cover 5 reaches the open position 5B and the opening/closing cover unit 34 reaches the open position 34B, the inclined face 54 formed in the protruding portion 53 is located above the protrusion 47 formed in the fixed frame 43.

In closing the opening/closing cover unit 34, an operation of rotating the opening/closing cover 5 downward is performed. Accordingly, since the link member 50 rotates such that the top end thereof is inclined forward (to the +Y side), the protruding portion 53 formed in the vicinity of the bottom end of the link member 50 slides in a state in which the inclined face 54 comes in contact with the protrusion 47 of the fixed frame 43 and the link member 50 moves such that the protruding portion 53 passes over the protrusion 47.

More specifically, with the operation of starting movement to the closed position 34A from the state in which the opening/closing cover unit 34 is supported at the support position 34C, the protruding portion 53 of the link member 50 passes over the protrusion 47. The operation of the link member 50 is a disengaging operation in which the link member once moves forward (to the +Y side) and then moves rearward (to the −Y side) when the protruding portion 53 passes over the protrusion 47. By this disengaging operation, the guide pin 42 engaging with the long hole 51 of the link member 50 moves forward (to the +Y side), passes over the engagement protrusion 45, and moves below the engagement protrusion 45. Accordingly, the engagement between the engagement protrusion 45 and the guide pin 42 is released. As a result, it is possible to close the opening/closing cover unit 34.

Operational Advantages

As described above, in the roll sheet printer 1 according to this embodiment, the roll sheet holder 41 moves from the storage position 41A close to the bottom of the printer case 2 to the takeout position 41B rising to the roll sheet input port 4 side by linking the roll sheet holder 41 with the opening operation of the opening/closing cover unit 34 opening and closing the roll sheet input port 4. The takeout position 41B is a position at which the roll sheet 12 can be taken out without much inputting a hand from the outside. Accordingly, a large space for inputting a hand into the roll sheet holder 41 does not need to be installed and the input and output of the roll sheet 12 can be performed with a small space. As a result, it is possible to maintain workability in replacing the roll sheet 12 and to decrease the size of the roll sheet printer 1. Since this mechanism is realized using a space-saving mechanism using the link members 50, the guide grooves 44, the guide pins 42, and the like, the roll sheet printer 1 is advantageous in a decrease in size.

In this embodiment, in the state in which the opening/closing cover unit 34 moves at the support position 34C slightly returned to the closed position 34A from the open position 34B, the guide pin 42 engages the engagement protrusion 45 of the guide groove 44 to regulate the downward movement of the link member 50. Accordingly, the roller sheet holder 41 can be supported at the holder support position 41C and the downward movement of the roller sheet holder 41 to the storage position 41A can be avoided even when the weight of the roll sheet 12 is applied to the roll sheet holder 41. As a result, it is possible to enhance workability in replacing the roll sheet 12.

In this embodiment, when the opening/closing cover unit 34 is closed, the protruding portion 53 formed in the link member 50 passes over the protrusion 47 of the fixed frame 43 and thus the engaged state between the engagement protrusion 45 and the guide pin 42 is released by this disengaging operation. Accordingly, when the roll sheet 12 is completely replaced, the state in which the roll sheet holder 41 is supported at the takeout position 41B can be released by only performing the operation of closing the opening/closing cover unit 34.

The roll sheet printer 1 according to this embodiment can have any of two types of postures such as the first set posture 1A and the second set posture 1B depending on the environment of an installation place, and is configured not to damage convenience of use even in any posture. Even in any posture, the roll sheet holder 41 moves from the deep side to the near side of the roll sheet input port 4 when the opening/closing cover unit 34 is opened. Accordingly, it is not necessary to much input a hand into the roll sheet holder 41 in order to take out the roll sheet 12. Since the roll sheet 12 can be taken out upward in the first set posture 1A and the roll sheet 12 can roll out from the front side in the second set posture, it is possible to maintain workability in replacing a roll sheet even in any posture.

What is claimed is:

1. A printer performing a printing operation on a roll sheet comprising:

a roll sheet holder in which the roll sheet is stored;

a roll sheet input port through which the roll sheet is input to the roll sheet holder;

an opening/closing cover unit that opens and closes the roll sheet input port;

a link member that links the opening/closing cover unit with the roller sheet holder;

a frame in which a guide groove is formed, wherein the guide groove includes protrusion, and the protrusion supports the movable shaft at a third position which is a position between the first position and the second position; and a movable shaft that moves along the guide groove, wherein the opening/closing cover unit is movable among an open position, a closed position, and a support position between the open position and the closed position, the link member moves the roll sheet holder to a takeout position at which the roll sheet is able to be taken out through the roll sheet input port when the opening/closing cover unit is moved to the open position, the link member moves the roll sheet holder to a storage position which is deeper in the roll sheet input port than the takeout position when the opening/closing cover unit is moved to the closed position, the movable shaft is disposed in a connecting portion of the roll sheet holder and the link member, the roll sheet holder is located at the takeout position when the movable shaft is located at a first position in the guide groove, and the roll sheet holder is located at the storage position when the movable shaft is located at a second position in the guide groove.

2. The printer according to claim 1, wherein the link member supports the opening/closing cover unit at the open position when the movable shaft is located at the first position in the guide groove, and The link member supports the opening/closing cover unit at the closed position when the movable shaft is located at the second position in the guide groove.

3. The printer according to claim 1, wherein the link member supports the opening/closing cover unit at the support position when the movable shaft is located at the third position in the guide groove.

4. The printer according to claim 3, wherein the movable shaft passes over the protrusion formed in the guide groove when the opening/closing cover unit starts movement from the support position to the closed position.

5. The printer according to claim 1, wherein the printer is able to be set in a first set posture in which the roll sheet input port faces a top side and a second set posture in which the roll sheet input port faces a front side, and the opening/closing cover unit is opened and closed in an up-down direction about a rear end thereof in the first set posture, and is opened and closed in a front-rear direction about a bottom end thereof in the second set posture.

6. A printer performing a printing operation on a roll sheet comprising:

a roll sheet holder in which the roll sheet is stored;

a roll sheet input port through which the roll sheet is input to the roll sheet input port;

an opening/closing cover unit that opens and closes the roll sheet input port;

a link member that links the opening/closing cover unit with the roller sheet holder;

a frame in which a guide groove is formed, wherein the guide groove is straight; and a movable shaft that moves along the guide groove, wherein the opening/closing cover unit is movable among an open position, a closed position, and a support position between the open position and the closed position, the link member moves the roll sheet holder to a takeout position at which the roll sheet is able to be taken out through the roll sheet input port when the opening/closing cover unit is moved to the open position, the link member moves the roll sheet holder to a storage position which is deeper in the roll sheet input port than the takeout position when the opening/closing cover unit is moved to the closed position, the movable shaft is disposed in a connecting portion of the roll sheet holder and the link member, the roll sheet holder is located at the takeout position when the movable shaft is located at a first position in the guide groove, and the roll sheet holder is located at the storage position when the movable shaft is located at a second position in the guide groove.

* * * * *